US006185897B1

(12) United States Patent
Johnson et al.

(10) Patent No.: US 6,185,897 B1
(45) Date of Patent: Feb. 13, 2001

(54) FLANGE CONNECTOR

(75) Inventors: Stephen R. Johnson, Flower Mound, TX (US); Charles Magnesio, Pittsfield, MA (US)

(73) Assignee: JVI, Inc., Lincolnwood, IL (US)

( * ) Notice: Under 35 U.S.C. 154(b), the term of this patent shall be extended for 0 days.

(21) Appl. No.: 09/334,292

(22) Filed: Jun. 16, 1999

(51) Int. Cl.[7] ..... E04B 1/38

(52) U.S. Cl. ..... 52/583.1; 52/699; 52/601; 52/715; 52/582.1

(58) Field of Search ..... 52/601, 578, 583.1, 52/582.1, 715, 699, 600

(56) References Cited

U.S. PATENT DOCUMENTS 1,280,485 * 10/1918 Kahn ..... 52/710
3,359,022 * 12/1967 Russell ..... 52/283
5,222,338 * 6/1993 Hull et al. ..... 52/405.3

* cited by examiner

*Primary Examiner*—Christopher T. Kent
*Assistant Examiner*—Jennifer I. Thissell
(74) *Attorney, Agent, or Firm*—Sonneschein Nath & Rosenthal; Jennifer H. Hammond

(57) ABSTRACT

The present invention relates to an improved flange connector 10 for adjoining adjacent concrete structural members 12. The flange connector 10 is a one-piece steel member having a faceplate 18, opposing faceplate returns 22, flattening bends 24, embedded legs 26 and reinforcing tabs 28. To allow the faceplate 18 to expand during welding, the opposing faceplate returns 22 extend away from the faceplate 18 at approximately ninety degree (90°) angles. The embedded legs 26 then extend from the faceplate returns 22 by way of flattening bends 24 that span between the embedded legs 26 and the faceplate returns 22. The flattening bends 24 extend away from the faceplate returns 22 at an angle that allows the embedded legs 26 to be positioned in a plane substantially parallel to the horizontal surface of the concrete structural members 12. To allow the flange connector 10 to flex in both the upward and downward directions, one flattening bend 24 extends from the upper portion of a faceplate return 22 and the opposing flattening bend 24 extends from the lower portion of the faceplate return 22. The length of the flattening bends 24 are such that one embedded leg 26 can be positioned above and one embedded leg 26 can be positioned below the reinforced mesh 30 in the concrete structural member 12. Reinforcing tabs 28 having holes 29 extend from the embedded legs 26 so that a reinforced steel bar 32 can be flexed through the reinforcing tabs 28 to mechanically tie the flange connector 10 to the mesh 30.

9 Claims, 5 Drawing Sheets

FLANGE CONNECTOR

FIELD OF THE INVENTION

This invention relates to a flange connector or metal weldable piece that is cast in the flanged edge of a concrete slab type structure such as a concrete structural tee. The flange connector of the present invention is used to adjoin adjacent concrete structural members by welding a lug or rod to adjacent flange connectors that are embedded in adjoining concrete structural members.

BACKGROUND OF THE INVENTION

Precast concrete structural members are widely used throughout the building industry because of the structural properties, ready availability and low costs of the members. The precast members are typically used to construct decks, such as roofs or floors, in large concrete structural members, such as parking garages. The precast members are manufactured in a facility and then shipped to the job site and erected. The precast members are typically double tee concrete structures, as illustrated in FIG. 6.

Each double tee member has a slab or load bearing surface and includes two flanged edges and two joists. To form a deck, long span, double tee precast members are laid side-by-side one another so that the flanged edges of members are abutting. These members may move relative to one another due to wind forces, thermal expansion and load changes. To prevent or lessen the relative horizontal and vertical movement between the abutting members and to provide added strength and rigidity to the structure, metal pieces may be embedded into the flanged edges of the members. Opposing metal pieces are then welded together with a lug or rod to provide the joinder. The metal pieces are commonly called weldments, weld plates or flange connectors.

At present, typical flange connectors are formed of one-piece metal members comprising (1) a front central plate having a planar weldable surface along one edge of the central plate member and (2) a pair of outstanding arms extending from the central plate member that are embedded in the concrete slab. The flange connectors are cast into the flanged edges of the double tee concrete structure typically at four to five foot centers, varying upon the size of the double tee structure and the amount of expected loading of the structure. The flanged edges are cast in the concrete structure such that the top edge of the central plate member of the flange connector is exposed. Exposing the top edge is accomplished by blocking out a portion of the flanged edge of the concrete member just above the central plate member. Having the top edge exposed allows two adjacent connectors to be welded to a lug or rod positioned between the two adjacent connectors, thereby developing a diaphragm across the floor or roof to increase the rigidity of such floor or roof. Because the opposing connectors often do not align perfectly with one another, a lug or rod is positioned between the opposing connectors. Rather than being welded directly to one another, the connectors are then welded to the intermediary lug or rod.

Examples of such typical flange connectors can be found in Ehlenbeck, U.S. Pat. No. 3,958,954, Lowndes, III, U.S. Pat. No. 4,724,649 and Klein, U.S. Pat. No. 5,402,616. The main problem with the prior art flange connectors, such as those taught by these patents, is that the flange connectors do not accommodate tension, are very rigid and fail dynamically, meaning that there is little deformation in the steel prior to failure and therefore, the failure is difficult if not impossible to anticipate.

Additionally, because concrete cannot handle tension, the precast concrete members are formed with reinforced mesh in the flanged edges of the members. The reinforced mesh is embedded into the center of the concrete slabs and is typically positioned to extend substantially parallel to the planar surface of the slabs.

To best absorb and transmit the forces on the flange connector, the reinforced mesh should be positioned not only in the middle of the concrete slab, but also in alignment with the center of the central plate of the flange connector. Thus, the location of the flange connector relative to the reinforced mesh is quite critical. Typically, the pair of outstanding arms of a flange connector are secured to the mesh or used to support the mesh and also act to align the flange connector with the mesh.

For example, in the case of Klien, U.S. Pat. No. 5,402,616, the outstanding arms are both positioned underneath the reinforced mesh to support the reinforced mesh and hold it in position while the concrete is being cast. The problem with using both outstanding arms to support the underside of the reinforced mesh is that the flange connector is only able to adequately absorb the shear force exerted in the downward direction. Without any means for absorbing the force in the upward direction, the quick flexure that occurs from the rapid changes in loading on a deck, especially in a parking lot, causes failure on the underside of the concrete structure.

Additionally, none of the prior art flange connectors that have outstanding arms provide for the expansion of the central faceplate during welding. The arms typically extend directly outward from the central plate at an approximately forty-five degree (45°) angle. By having the arms extending directly outward from the central plate at forty-five degree (45°) angles, the angles function to compress the faceplate, thereby making it difficult for the faceplate to expand without cracking the surrounding concrete during welding. Finally, none of the prior art flange connectors have been suitable for withstanding seismic loading conditions and dynamic forces without dynamic failure.

SUMMARY OF THE INVENTION

Accordingly, the principal object of the present invention is to provide a flange connector that absorbs the shear force occurring in both the upward and downward direction and allow the flange connector to flex such that any failure in the connection is a ductile failure that can be detected through an inspection of the joint.

Yet another object of the present invention is to provide a flange connector that can withstand seismic loading conditions and dynamic forces without failure.

Still another object of the present invention is to allow the face or central plate of the flange connector to expand during welding and thereby avoid any cracking of the concrete.

To achieve these objectives, the flange connector 10 of the present invention is a onepiece steel member having a faceplate 18, opposing faceplate returns 22, flattening bends 24, embedded legs 26 and reinforcing tabs 28. The faceplate 18 is the central plate of the flange connector 10 that is welded to opposing faceplates 18 with a lug or rod. To allow the faceplate 18 to expand during welding, two opposing faceplate returns 22 extend away from the faceplate 18 at approximately ninety-degree (90°) angles. The ninety degree (90°) angles do not function to compress the faceplate 18 as do the more acute angles, and therefore, allow for the expansion of the faceplate 18 without causing fatigue to the concrete.

The embedded legs 26 are then formed from the faceplate returns 22 through flattening bends 24 that span between the embedded legs and the faceplate returns 22 such that the embedded legs 26 can be positioned in a plane substantially parallel to the horizontal surface of the concrete members 12. One flattening bend 24 extends from the upper portion of the faceplate return 22 while the opposing flattening bend 24 extends from the lower portion of the faceplate return 22. This is to allow the flange connector 10 to flex in both the upward and downward directions.

The length of the flattening bends 24 are such that one embedded leg 26 can be positioned above the reinforced mesh 30 and the other embedded leg 26 can be positioned below the reinforced mesh 30. Thus, the mesh 30 is held between the embedded legs 26. Again, this allows for the flange connector 10 to absorb the shear forces occurring in both the upward and downward direction. Finally, the embedded legs 26 are designed with reinforcing tabs 28 having holes 29 so that a reinforced steel bar 32 can be flexed through the holes 29 in the reinforcing tabs 28. This creates a mechanical tie through the mesh 30 and is especially desirable for designs that dictate flange fatigue from seismic and dynamic loading.

These and other objects and advantages of the present invention will be clarified in the following description of the preferred embodiment in connection with the drawings, the disclosure and the appended claims, wherein like reference numerals represent like elements throughout.

DESCRIPTION OF THE PREFERRED EMBODIMENT

Figure 1:
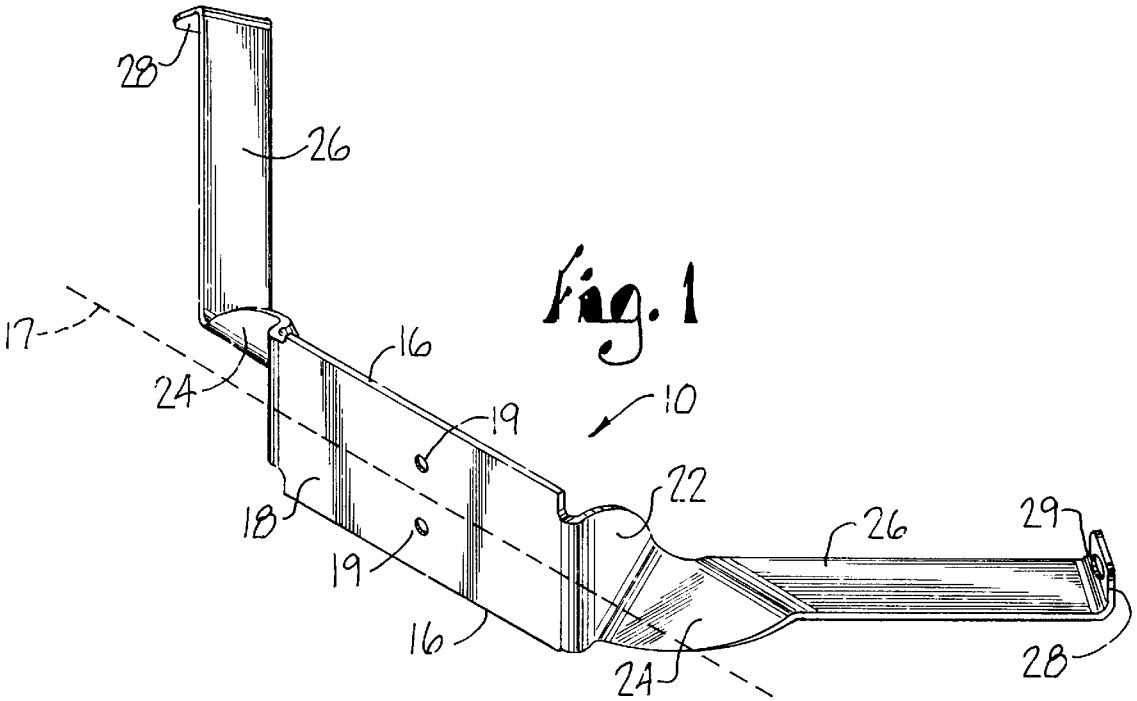
FIG. 1 is a perspective view of a flange connector of the present invention.

As can be seen in all the figures, but as best illustrated by FIGS. 1–5, the flange connector 10 of the present invention is comprised of a one-piece member having a faceplate 18, opposing faceplate returns 22, flattening bends 24, embedded legs 26 and reinforcing tabs 28. The flange connector 10 is preferably comprised of either mild grade steel or a stainless steel.

The faceplate 18 of the flange connector 10 is approximately six inches in width, but may vary depending upon the size of the structural member 12 and the anticipated load, and has straight top and bottom edges 16. Having a straight top edge 16 maximizes the welding area that is exposed after the field alignment of the adjacent connector 10. Additionally, the faceplate 18 has two approximately one quarter inch holes 19 to allow the flange connector 10 to be fastened to the formwork with positive draft (or turned over for negative draft) when pouring a precast concrete member 12. As shown in FIGS. 1, 2, 3, and 5, each faceplate 18 also has two opposing faceplate returns 22, one located on each side of the faceplate 18. The faceplate 18 thus has a longitudinal axis 17 running from the two opposing faceplate returns 22. Each faceplate return 22 extends away from the faceplate 18 at an approximately ninety degree (90°) angle. By positioning the faceplate returns 22 at approximately ninety degree (90°) angles relative to the faceplate 18, the faceplate 18 is allowed to flex or expand when the heat is applied to the faceplate 18 during welding. By allowing the faceplate 18 to expand, the excessive structural stresses caused by the heat from the welding are diffused, thereby minimizing the amount of cracking in the concrete structural member 12.

As illustrated in FIGS. 1, 3, 4, 5 and 8, the flattening bends 24 extend from the faceplate returns 22 and span between the faceplate returns 22 and the embedded legs 26. These flattening bends 24 are angled at an approximately forty-five degree (45°) angle relative to the horizontal plan of the precast concrete member 12. The angle of the flattening bends 24 may, however, vary depending upon the design of the flange connector 10. Regardless of the angle, the function of the flattening bends 24 should remain the same, which is to position the embedded legs 26 in a substantially parallel plane with not only the horizontal surface of precast member 12, but also the steel reinforcing bars or mesh 30 positioned within the flanged edge 14 of the double tee member 12.

Figure 2:
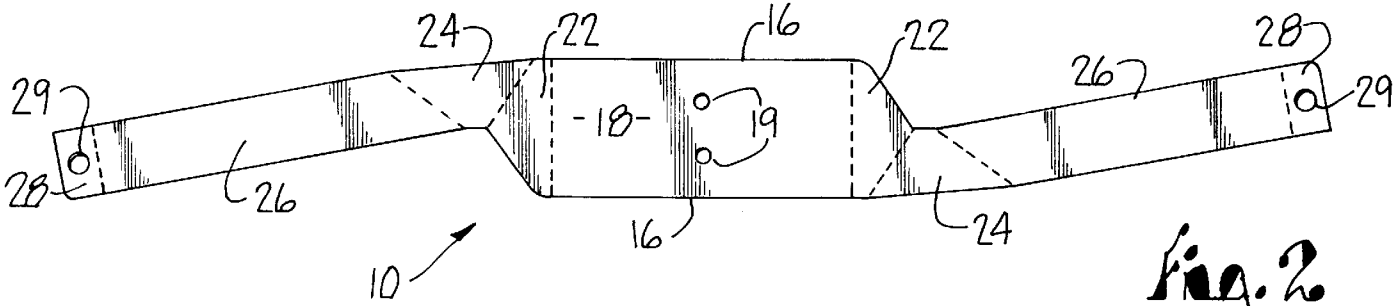
FIG. 2 is a layout pattern of a flange connector of the present invention.
Figure 3:
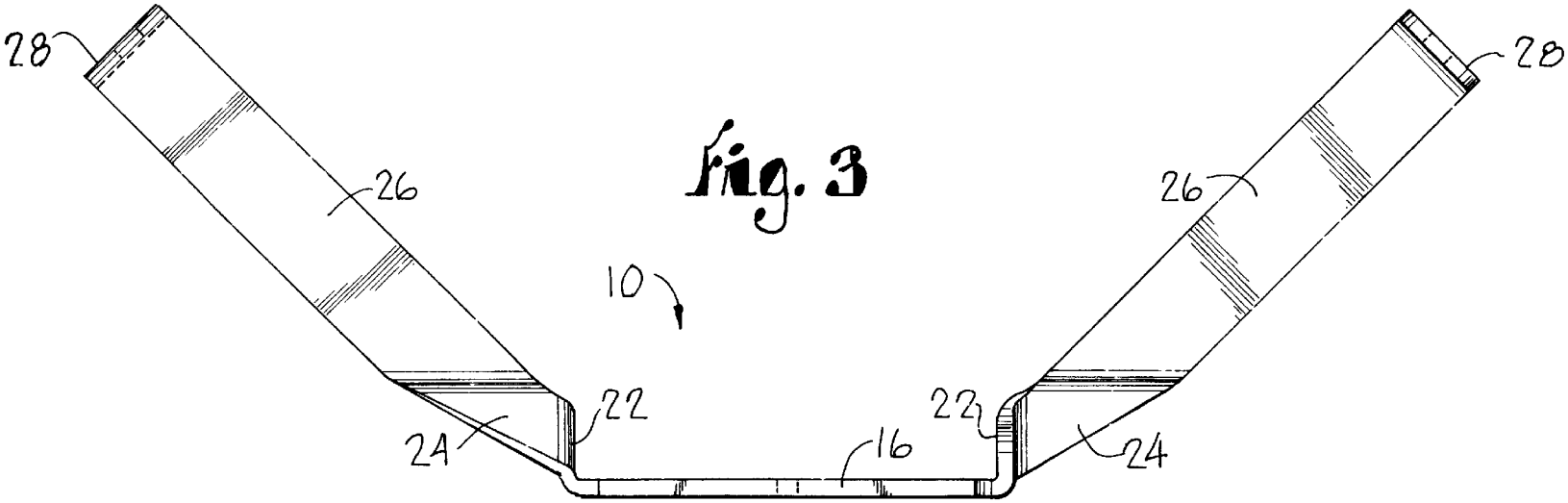
FIG. 3 is a plan view of a flange connector of the present invention.
Figure 4:
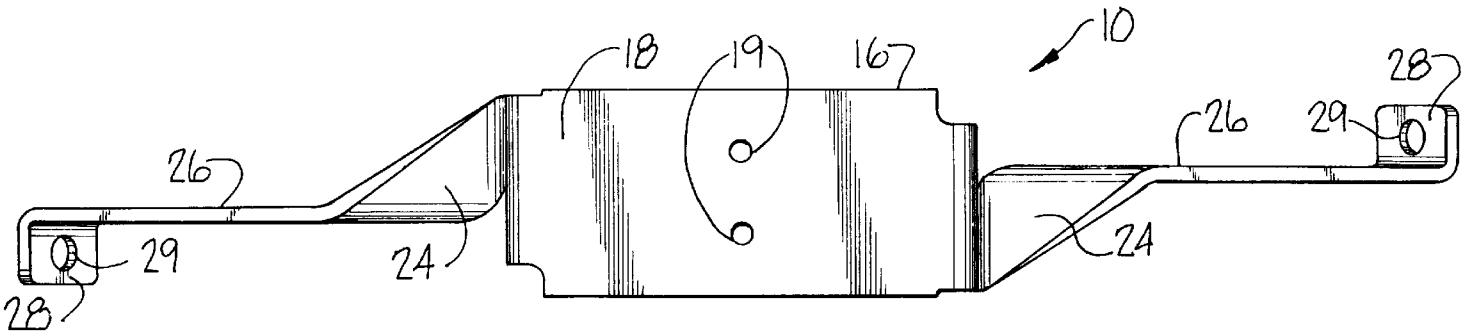
FIG. 4 is a front elevational view of a flange connector of the present invention.
Figure 5:
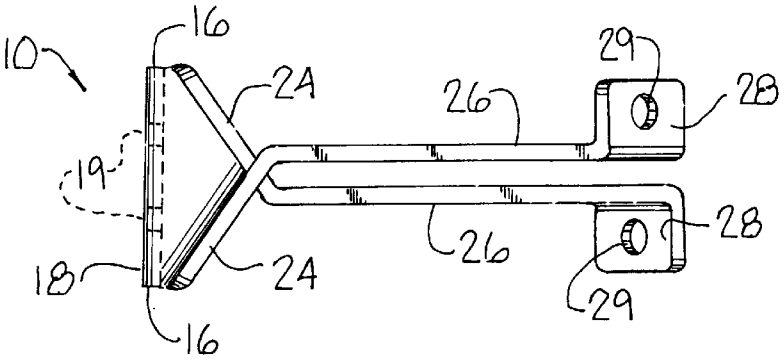
FIG. 5 is a side elevational view of a flange connector of the present invention.
Figure 8:
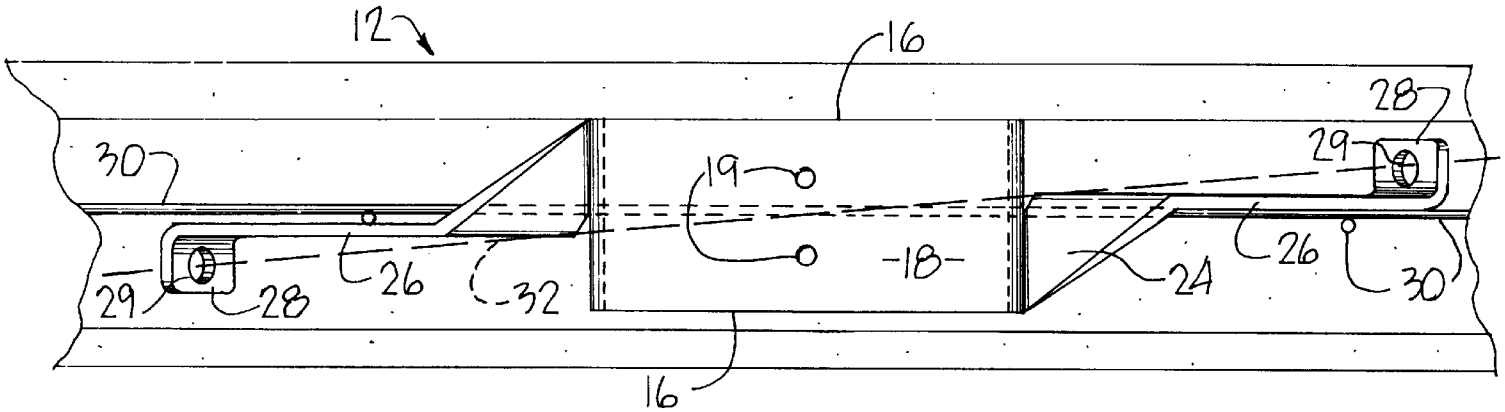
FIG. 8 is a front elevational view of a flange connector of the present invention, as it would appear cast in a precast concrete structural tee.

As also shown in FIGS. 1, 2, and 4, the height of each flattening bend 24 is less than the height of each faceplate return 22. The height of each flattening bend 24 is, however, equivalent to the height of the contiguous embedded leg 26 when in its layout pattern, as seen in FIG. 2. As also shown in FIGS. 1, 4 and 8, the opposing flattening bends 24 extend from opposing portions of the faceplate returns 22. One flattening bend 24 extends from the upper portion of the faceplate return 22 downward approximately thirty-five degrees (35°) relative to the faceplate 18, while the other flattening bend 24 extends upward from the lower portion of the opposing faceplate return 22 approximately thirty-five degrees (35°) relative to the faceplate 18. While both flattening bends 24 could be designed to extend from either the lower or upper portion of the faceplate returns 22, the structural integrity of the flange connector 10 would be compromised if the flattening bends 24 were to extend in the same direction. The flattening bends 24 are designed to extend from opposing portions of the faceplate returns 22 so that the flange connector 10 can best prevent fatigue from both the upward and downward vertical shear forces bearing on the precast members 12.

Additionally, to insure proper absorption and transmission of the forces received by the flange connector 10, the reinforced mesh 30 in the concrete structure 12 must be positioned so that the mesh 30 is centered with the faceplate 18. This is accomplished through the positioning of the embedded legs 26 above and below the mesh 30. As shown in FIGS. 2, 4, 5, 7 and 8, the length of each flattening bend 24 between the faceplate return 22 and the embedded leg 26 is such that one embedded leg 26 is positioned to rest above the reinforced mesh 30 within the flanged edge 14 of the concrete member 12 and the other leg 26 is positioned just beneath the mesh 30.

Figure 9:
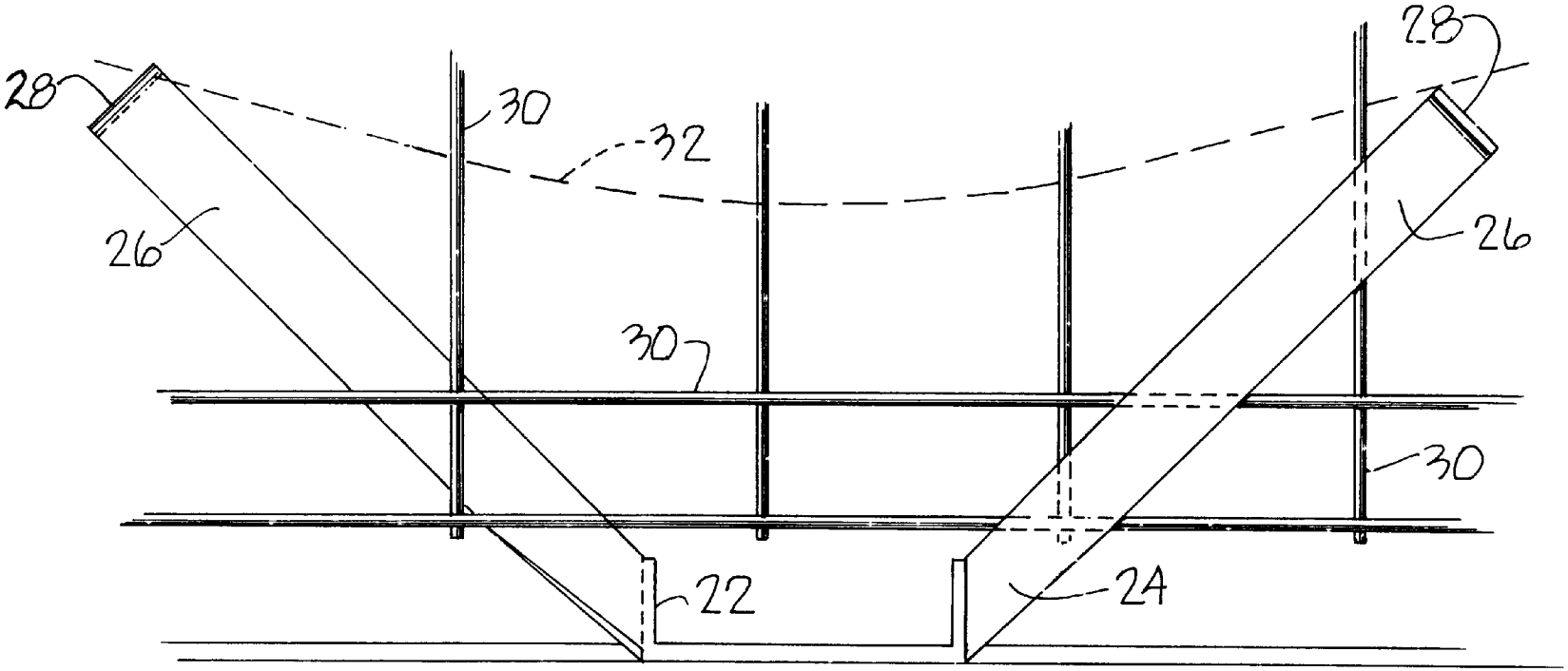
FIG. 9 is a plan view of a flange connector of the present invention illustrating the placement of the reinforced mesh within the arms of the flange connector.

To mechanically tie the flange connectors 10 to the double tee members 12, the embedded legs 26 have reinforcing tabs 28 extending from the ends of the legs 26, as illustrated in FIG. 4. These reinforcing tabs 28 have holes 29 in the tabs 28 for receiving a reinforced steel bar 32. The steel bar 32 can be flexed into each of the holes 29 in the tabs 28, as illustrated in FIGS. 8 and 9. The skew of the holes 29 in the tabs 28 relative to the reinforced bar 32 then locks the bar 32 in place when it is released from flexing. This mechanical tie is typically required for designs that demonstrate flange fatigue from considerable frequency or from seismic frequency and is optional.

Figure 6:
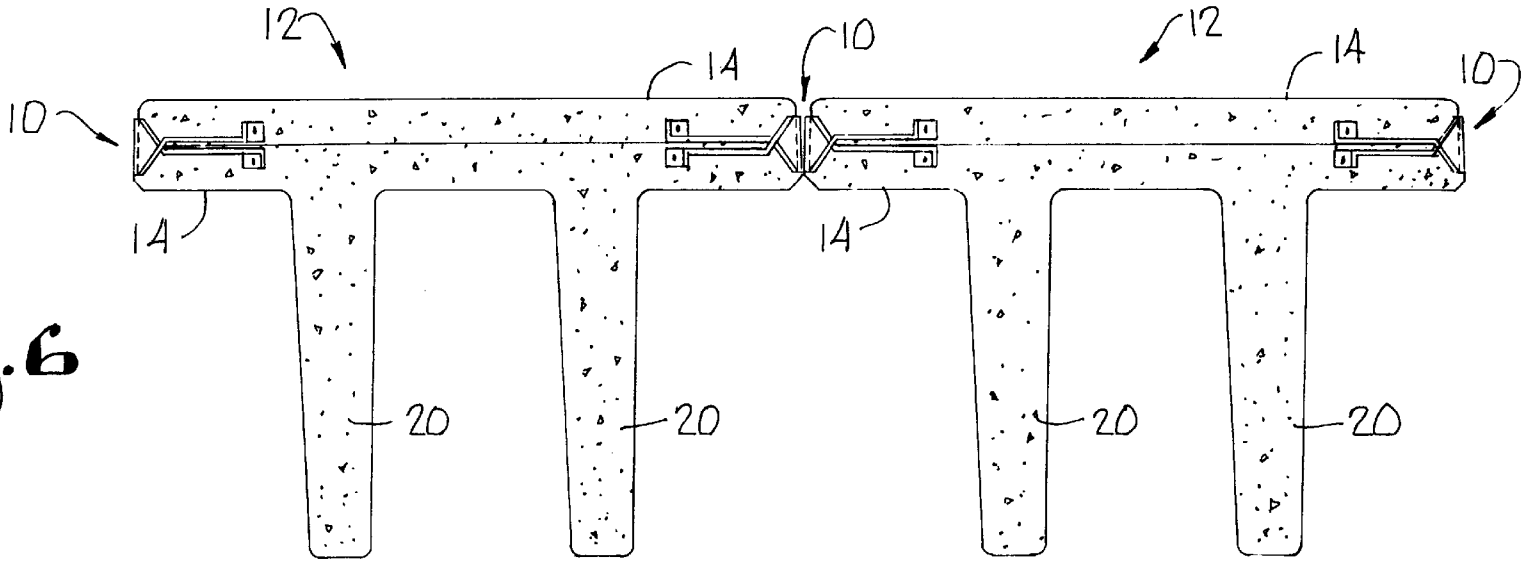
FIG. 6 is a cross sectional view of two aligned precast concrete structural tees having flange connectors of the present invention cast therein.

FIG. 6 illustrates two flange connectors 10 of the present invention, as they would appear cast into opposing flanged edges 14 of precast concrete double tee structural members 12. As illustrated by FIGS. 6–9, the flange connectors 10 are cast into the double tee members 12 such that the faceplate 18 of a flange connector 10 on one double tee member 12 opposes the faceplate 18 of a flange connector 10 on another double tee member 12 when the double tee members 12 are positioned side-by-side one another (as shown in FIG. 6). The flange connectors 10 are cast into the flanged edges 14 of the double tee concrete structure 12 such that top edge 16 of the faceplate 18 of the flange connector 10 is exposed.

Figure 7:
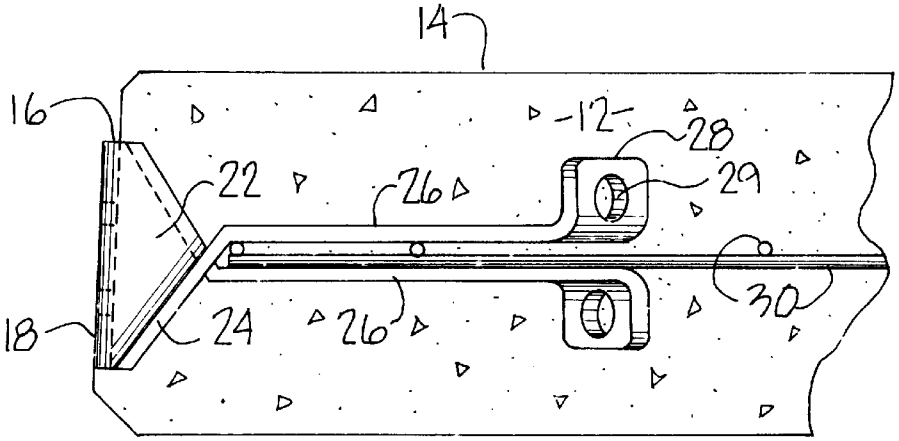
FIG. 7 is a partial cross sectional view of a precast concrete structural tee having a flange connector cast therein.

As seen in FIGS. 6 and 7, this is accomplished by blocking out a portion of the flanged edge 14 just above the faceplate 18 of the connector 10 during formation of the concrete structure 12, and thereby exposing the top edge 16 of the faceplate 18. Having the top edge 16 exposed allows two adjacent connectors 10 to be welded to one another with an intermediary connecting lug or rod, developing a diaphragm across the floor or roof to increase the rigidity of such floor or roof. As discussed previously, having a straight top edge 16 further optimized the exposure of the top edge 16.

Although the foregoing detailed description of the present invention has been described by reference to a single exemplary embodiment, and the best mode contemplated for carrying out the present invention has been herein shown and described, it will be understood that modifications or variations in the structure and arrangement of this embodiment other than those specifically set forth herein may be achieved by those skilled in the art and that such modifications are to be considered as being within the overall scope of the present invention. Therefore, it is contemplated to cover the present invention and any and all modifications, variations, or equivalents that fall within the true spirit and scope of the underlying principles disclosed and claimed herein. Consequently, the scope of the present invention is intended to be limited only by the attached claims.

We claim:

1. A flange connector comprising:

a central faceplate, said faceplate having a longitudinal axis;

a first and second opposing faceplate return, each said faceplate return extending from said central faceplate at approximately ninety degree (90°) angles from said faceplate;

a first and second flattening bend, said first flattening bend extending from said first opposing faceplate return and said second flattening bend extending from said second faceplate return;

a first and second embedded leg, said first embedded leg extending from said first flattening bend and said second embedded leg extending from said second flattening bend, each said embedded leg being positioned in a plane substantially perpendicular to said faceplate and substantially parallel to said longitudinal axis of said face plate, said flattening bends angled between said faceplate return and said embedded legs to enable said embedded legs to be positioned in the plane and to allow said flange connector to flex under shear and tension forces.

2. A flange connector as recited in claim 1 wherein said flange connector further comprises a first and second reinforcing tab, said first reinforcing tab extending from said first embedded leg at an approximately ninety degree (90°) angle relative to said first embedded leg and said second reinforcing tab extending from said second embedded leg at an approximately ninety degree (90°) angle relative to said second embedded leg.

3. A flange connector as recited in claim 2 wherein said first and second reinforcing tabs each have holes for receiving a reinforcing bar.

4. A flange connector as recited in claim 1 wherein said first flattening bend extends from the upper portion of said first face plate return and said second flattening bend extends from the lower portion of said second face plate return.

5. A flange connector as recited in claim 1 wherein said first and second flattening bends are of a length that allow one said embedded leg to be positioned above the other said embedded leg.

6. A flange connector comprising:

a face plate, said faceplate having a longitudinal axis and having returns extending from the sides of each face plate that are angled to allow the face plate to expand under extreme heat;

at least two embedded legs that extend from said face plate return such that the legs initially extend away from said face plate return at an angle and then flatten out in a plane substantially perpendicular to the face plate and substantially parallel to said longitudinal axis of said faceplate.

7. A flange connector as recited in claim 6 wherein one said embedded leg extends from the upper portion of one said face plate return and a second said embedded leg extends from the lower portion of the other said face plate return.

8. A flange connector as recited in claim 6 further comprising reinforcing tabs extending from said embedded legs.

9. A flange connector as recited in claim 8 wherein said reinforcing tabs have at least one hole for receiving at least one reinforcing bar.

* * * * *